United States Patent [19]

Minnick

[11] Patent Number: 4,962,547

[45] Date of Patent: Oct. 16, 1990

[54] GOLF GLOVE

[76] Inventor: Jim Minnick, 9149 Meadowview Rd., Bloomington, Minn. 55425

[21] Appl. No.: 369,515

[22] Filed: Jun. 21, 1989

[51] Int. Cl.[5] ..... A41D 19/00

[52] U.S. Cl. ..... 2/161 A; 2/167

[58] Field of Search ..... 2/161 A, 167, 167; 273/183 B

[56] References Cited

U.S. PATENT DOCUMENTS

| | | | |
|---|---|---|---|
| Re. 28,661 | 12/1975 | Tredway, Sr. | 2/161 A |
| 342,833 | 6/1886 | Mays et al. | 2/167 |
| 3,255,461 | 6/1966 | Bullock | 2/167 |
| 3,600,715 | 8/1971 | Perrella | 2/161 A |
| 3,649,967 | 3/1972 | Millman | 2/161 A |
| 3,762,719 | 10/1973 | Smith | 273/183 B |
| 3,811,684 | 5/1974 | Tredway, Sr. | 2/161 A |
| 3,848,874 | 11/1974 | Elkins, Jr. | 273/183 B |
| 4,000,903 | 1/1977 | Swanson | 2/161 A |
| 4,257,607 | 3/1981 | Nedwick | 273/183 B |
| 4,329,741 | 5/1982 | Bach | 2/161 A |
| 4,639,947 | 2/1987 | Lanscioni | 2/161 A |
| 4,691,388 | 9/1987 | Boone | 2/161 A |
| 4,730,354 | 3/1988 | Saito | 2/161 A |
| 4,776,595 | 10/1988 | Wilkins | 273/183 B |
| 4,882,787 | 11/1989 | Hull et al. | 2/161 A |

*Primary Examiner*—Paul T. Sewell
*Assistant Examiner*—Ted Kavanaugh
*Attorney, Agent, or Firm*—Robert C. Baker

[57] ABSTRACT

A golf glove for the hand of the user placed highest on the club comprising backside panels inlcuding a grip indicator panel area defined as the area covering the backside of the user's little and ring fingers down to the tip and also covering the portion of the backside of the body of the user's hand between the outside edge of the hand opposite the thumb and a line substantially parallel to outside edge intersecting the juncture between the ring and middle fingers. The indicator panel area is visually distinct from the remaining areas of the glove, so as to give the user an indication of the orientation of the grip on the club by the visibility of any portion of the indicator panel area as the user addresses a golf ball in preparation to strike it.

9 Claims, 2 Drawing Sheets

GOLF GLOVE

BACKGROUND OF THE INVENTION

This invention relates to a golf glove that visually indicates to the wearer the orientation of his or her grip on a golf club.

The prior art has attempted to indicate correct grip position by attaching extra devices to the glove or by adding alignment marks on the glove and also on the golf club. These require cumbersome additions or bothersome or tedious modifications not only to the glove but also to the golf club. Even worse, the prior art approaches signal other players that the user of the prior art expedients is indeed using an extra aid for the orientation of his or her grip. What has been needed is a visual indicator system for correct grip that is totally unobtrusive, easily used while at the same time not being particularly apparent to any one other than the user, and one that adds nothing in terms of bulk to a glove and nothing at all to a golf club. Major merit of this invention lies in the fact that it provides a simple technique whereby the user can determine correctness of grip in a manner consistent with tournament golf rules and without having to concern himself or herself with the objectionable extra bulk of special devices or unsightly extra marks on a golf club.

SUMMARY OF THE INVENTION

The new golf glove visual indicator system provides the wearer of the glove with an immediate visual indication of the grip orientation. The indicator is integrated into the glove construction by making the external surface of one particular panel area of the backside of the glove visually distinct from the other backside panel areas. The distinctness of the indicator panel may be accomplished by varying the color, pattern, or material of it with respect to the rest of the glove. While wearing the golf glove and gripping a golf club, the wearer may quickly and easily check the orientation of his or her grip on the club by his ability or inability to see the indicator panel area and where the indicator panel area appears.

As the wearer grips the club and addresses the ball for a stroke at it, the golfer has simply to look down at his or her gloved hand grip on the club. If no part of the visually distinct indicator panel is visible to the wearer while gripping the club in an addressing stance, this tells the wearer that the grip on the club is neutral. If, however, the golfer can see a significant portion of the indicator panel area, the grip is not neutral. The grip is therefore either strong or weak, and this is indicated by the portion of the indicator panel area that is visible. If the portion of the indicator panel area that covers the back of the body of the hand is significantly visible, then the grip on the club is strong. If, on the other hand, the portion of the indicator panel area visible is on the backside panel areas of the ring or little fingers, the wearer then knows that the grip is weak. With this knowledge, the wearer can either maintain or adjust the grip to suit his or her personal preference or in accordance with a golf professional's instructions. This adjustment can be made by checking the visibility of the indicator panel area or portion of it, if any, as the grip is changed.

DESCRIPTION OF THE PREFERRED EMBODIMENTS

Figure 1:
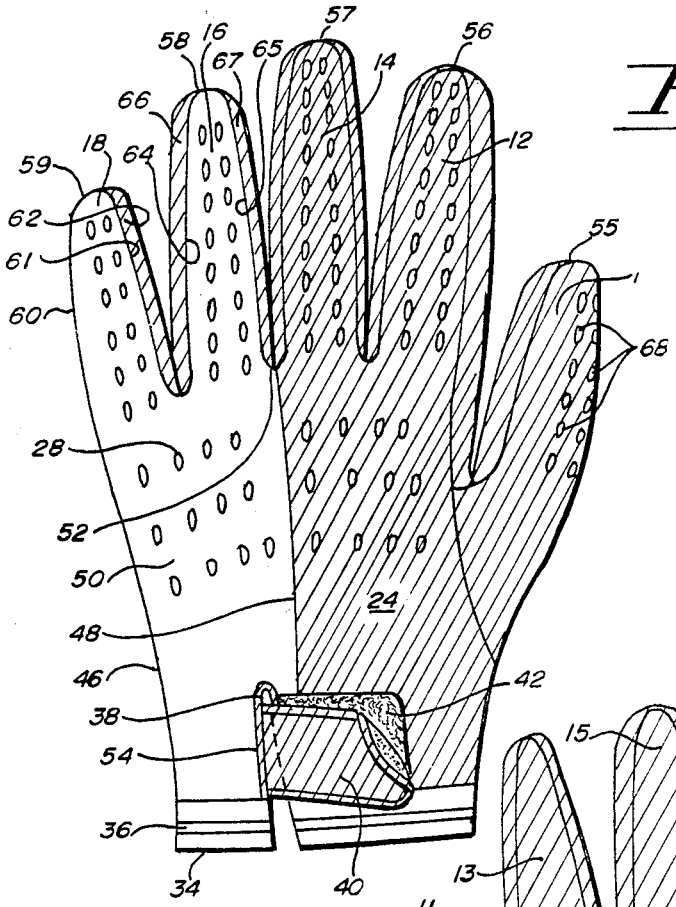
FIG. 1 is a schematic view of the backside of a golf glove according to the invention and shows the location of the indicator panel area with respect to the rest of the backside.

The elements making up the new golf glove are given the same numbering in all Figures of the drawing.

Referring to FIG. 1, the panel areas of material making up the glove correspond to the parts of the hand. The hand body is the central portion to which the digits are attached. The glove has panel areas covering the hand body backside panel area 24 and the appended digit panel areas, namely the backside thumb panel area 10, the backside index finger panel area 12, the backside middle finger panel area 14, the backside ring finger panel area 16, and the backside little finger panel area 18. The points on the backside finger panel areas furthest from the hand body backside panel area are the thumb tip 55, the index finger tip 56, the middle finger tip 57, the ring finger tip 58, and the little finger tip 59.

Figure 2:
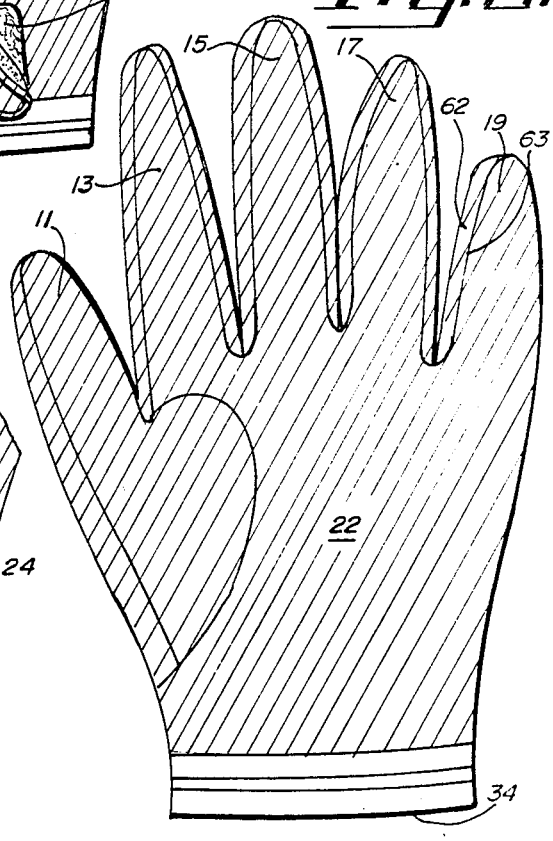
FIG. 2 is a schematic view of the palm side of the golf glove.

Referring to FIG. 2, the glove has a hand body palm side panel area 22, to which is appended the palm side thumb panel area 11, the palm side index finger panel area 13, the palm side middle finger panel area 15, the palm side ring finger panel area 17, and the palm side little finger panel area 19. The various glove panel areas may contain holes 28 for comfort ventilation.

Referring back to FIG. 1, the portions of the panel areas at the wrist form the cuff 34. The cuff 34 suitably may have sewn to it or integrated into it an elastic band 36. The hand body edge seam 46 joins the hand body palm side panel area 22 and the hand body backside panel area 24 at the edge of the glove opposite the thumb panel areas 10 and 11. The hand body backside panel area 24 has a slit 38 into it from cuff 34 and the slit is usually parallel to the hand body outside edge seam 46. This slit may extend into the backside hand body 24 up to about three-quarters of the distance from the cuff to the base of attached backside finger panel areas. Normally the slit is relatively closer to the outside seam 46 than to the inside edge of the glove where the thumb structure is located. The edge of the slit 38 nearest the hand body outside edge seam 46 has sewn to it a fastener flap 40 of a slit closure device. Flap 40 removably fastens to a base part 42 the slit closure device. The base fastener part 42 suitably is a surface patch near the edge of slit 38 opposite the edge to which flap 40 is fixed. Flap 40 and base part 42 are conveniently provided with fastening means such as hook-like and loop-like elements commonly available under the trademark "Velcro".

The glove has a more or less bisecting line 48 that extends from the juncture 52 of the backside middle finger panel area 14 and backside ring finger panel area 16. Line 48 is substantially straight and substantially parallel to the hand body edge seam 46. It extends down the hand body backside panel area 24 toward the cuff of the glove and normally terminates at the edge of base part 42 of the fastener or closure device for the slit. The slit 38 lies between the line 48 and the hand body edge seam 46; and the preferred location for the slit is approximately midway between line 48 and edge 46.

The indicator panel area 50 is the most significant structure of this new glove. It extends laterally from the hand body outside edge seam 46 across the hand body backside panel area 24 to the bisecting line 48. The indicator panel area 50 normally should not be so extensive as to include the slit closure flap 40 or the slit closure patch 42. Longitudinally (i.e., in the finger direction) the indicator panel area 50 extends from the little finger tip 59 and the ring finger tip 58 down the panel areas 18 and 16 of the little and ring fingers and across the hand body backside panel area 50 substantially and preferably to the cuff 34, without however extending into closure or fastening members 40 and 42.

The boundary or perimeter of the indicator panel area 50 can be described as follows: beginning at the little finger tip 59, it extends down the little finger backside inside seam 61. It continues about the ring finger backside outside seam 64 to the tip 58 and then follows the ring finger backside inside seam 65 to the juncture 52 of the backside middle finger panel area 14 and the backside ring finger panel area 16. The boundary continues down the bisecting line 48 to the slit closure device 40 and 42, where it follows the lateral edge of the slit closure device. It continues around the apex of the slit 38 to the outside edge of the slit 38 (i.e., the edge of the slit closest to the hand body edge seam 46). It then continues down along the outside edge of the slit along the slit closure flap seam 54 to the cuff 34. The boundary follows the cuff 38 to the hand body edge seam 46 at which it follows the hand body edge seam 46 and the little finger outside seam 60 to the point of its beginning at the little finger tip 59.

The indicator panel area 50 does not extend to include the little finger inner side panel 62. That panel 62 lies between the little finger inside backside seam 61 and the little finger inside palm side seam 63, nor does it include the ring finger outer side panel 66, which lies between the ring finger backside outside seam 64 and the palm side ring finger panel area 17. Also not included is the ring finger inner side panel 67, which lies between the ring finger inside backside seam 65 and the palm side ring finger panel area 17.

Figure 6:
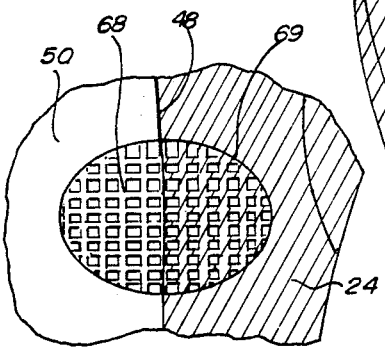
FIG. 6 is a schematic fragmentary view of a backside body portion of a golf glove according to the invention, with an open mesh weave insert for ventilation.

As shown in FIG. 6, a mesh panel 68 may be integrated into the hand body backside panel area and joined to other parts of paneling on the backside by a seam 69. The distinctive indicator panel area 50 remains as aforedescribed, i.e., it extends into a portion of the mesh. Mesh of an open weave (or wide-apart strands) is sometimes employed to increase ventilation characteristics. To be emphasized is that the indicator panel area does not extend over the whole of the mesh illustrated in FIG. 6. Importantly, panels forming the glove may be of varied shape joined by variety of seams (preferably kept at a minimum). Thus, the indicator panel area may or may not consist of a single panel. It, however, covers an external backside area of the glove as aforedescribed.

Leather such as animal hide appropriately treated or tanned, as well as artificial leather, and also cloth, may be employed for the panels of the glove. The panels usually are sewn together along seams, although adhesives may be employed to join panels. The material out of which the glove is formed may vary without departing from the essence of the invention.

The essence of the invention lies in the distinctive indicator panel area and its functions and relationships to remaining areas of the external surface of the glove. Preferably, a solid color indicator panel area 50 is employed to create distinctness and contrast from remaining external surfaces of the glove. For example, the color white for the external surface of the indicator panel area 50 provides dramatic visual distinctness when the remaining external surface areas (or at least the backside surface areas) of the glove are black, and very satisfactory distinctness even when remaining areas are in some other relatively dark or strongly contrasting color such as brown, blue, red, green, yellow, etc. Alternatively the indicator area may be black or some other color from white, with white or some other contrasting color for the remaining external areas. Some illustrative contrasting color combinations are: yellow-blue, brown-tan, red-black, green-white, etc. The contrast between selected colors should be eye-catching enough for the eye to easily distinguish the indicator area 50 from other areas at arms length. All remaining surfaces of the glove should be of contrasting color to the indicator panel 50, but not necessarily contrasting among themselves. If there are separate panels of material to cover the sides of the fingers (i.e. connected to both the hand body palm side panel area 22 and the hand body backside panel area 24), these sections should also contrast with the indicator panel area 50. The indicator panel area 50 is most preferably formed so as to consist of a single panel of material united to adjoining panel areas. The indicator panel area 50 could, in the alternative, be created by simply dyeing the indicator panel area 50 a contrasting color to the other areas of a single backside panel for the glove.

The indicator panel area 50 may optionally but less preferably be created by using a contrasting pattern of material for that area, and distinctively different pattern or solid color for other areas, or vice versa. As long as the required eye-catching visual distinctness is maintained between indicator panel area 50 and other areas, especially those adjacent the boundary or perimeter of the indicator area, benefits of the invention can be realized. Even contrasting weave densities might be employed. However, the greatest realization of the benefits of the invention arises from the use of a solid color indicator panel area, in combination with vividly or dramatically contrasting color for other areas.

Significant advantages flow from a golfers use of the glove of this invention. As conventional for golf gloves, the glove of this invention is placed on the hand of the golfer selected for placement highest on the shaft of a golf club. Some golfers refer to this as the hand that effects the greatest draw or pulling power as a golf club is swung in a power stroke. It is always the hand on the side of the golfer where the golf ball will travel after it is hit.

Normally the golfer will then address the ball, which involves spacing feet apart at an appropriate distance consistent with the type of golf club to be selected for use, and also distancing the feet from the golf ball consistent with the type of club selected for use. (The glove of the invention is not particularly adapted for putting use, although it may serve as a guide for a suitable grip even under putting conditions.) Generally, as the golfer selects his or her addressing stance, he or she will have previously selected the particular golf club for use in striking the ball. The addressing stance is selected and corrected by holding the golf club in one's gloved hand (sometimes with both hands on the club) with the head of the club adjacent or very near the golf ball to be hit.

After the golfer has settled on the addressing stance, the golfer will normally settle on his or her grip of handle of the golf club for striking the ball. The hand covered with the golf glove is first applied; and this is done while maintaining the addressing stance. Then the other hand of the golfer normally is placed in interlocked or at least adjacent condition on the handle of the golf club at a location below the gloved hand.

Figure 3:
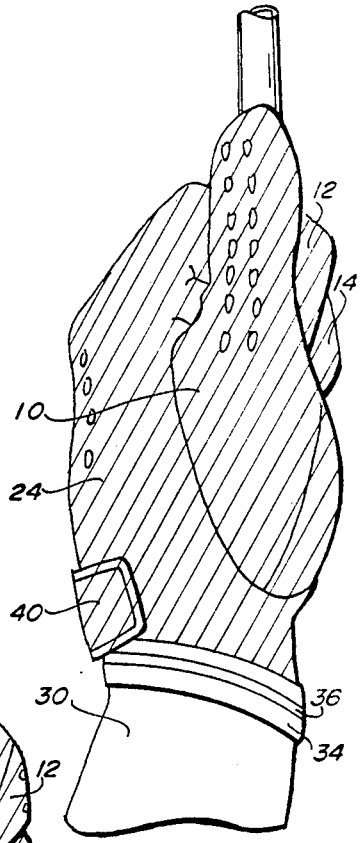
FIG. 3 is a schematic elevational view of a hand wearing the golf glove and gripping a golf club in a neutral grip as the user would view it.

If the gloved hand, as viewed by the golfer by downward glance, gives the appearance illustrated in FIG. 3, with no part of the indicator panel 50 visible at the downward glance (i.e., both the hand body backside area and the middle and ring finger backside areas of the indicator panel 50 being obscured by the bulk of the golfers gloved hand), the golfer immediately knows that he or she has selected a grip of essentially neutral character and one commonly recommended at least for iron strokes by many golf professionals.

Figure 4:
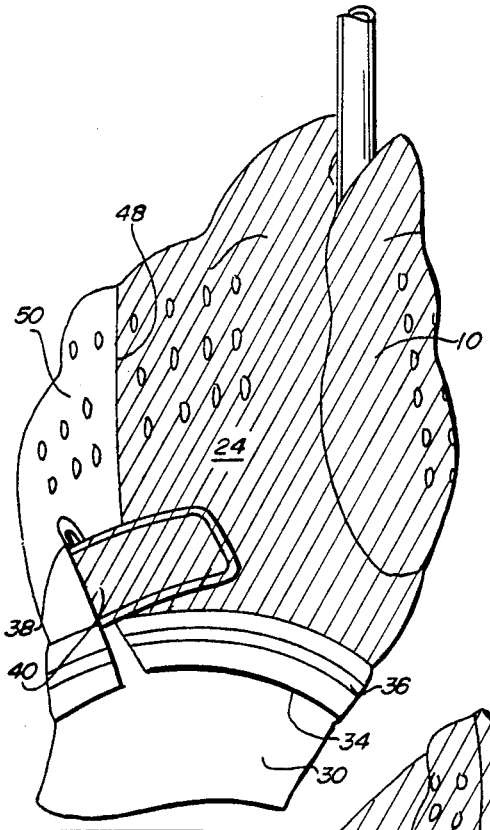
FIG. 4 is a schematic elevational view of a hand wearing the golf glove and gripping a golf club in a strong grip as the user would view it.

On the other hand, if a golfer observes at the downward glance that little and ring finger backside areas are totally obscured from view by the golfers thumb side, but a portion of the indicator panel 50 over the backside of the golfers hand body is viewable, then the golfer knows that the grip selected is one of strength or power; and this type of grip, or a modified form of it, is frequently recommended by golf professionals for driving use. It is illustrated in FIG. 4.

Figure 5:
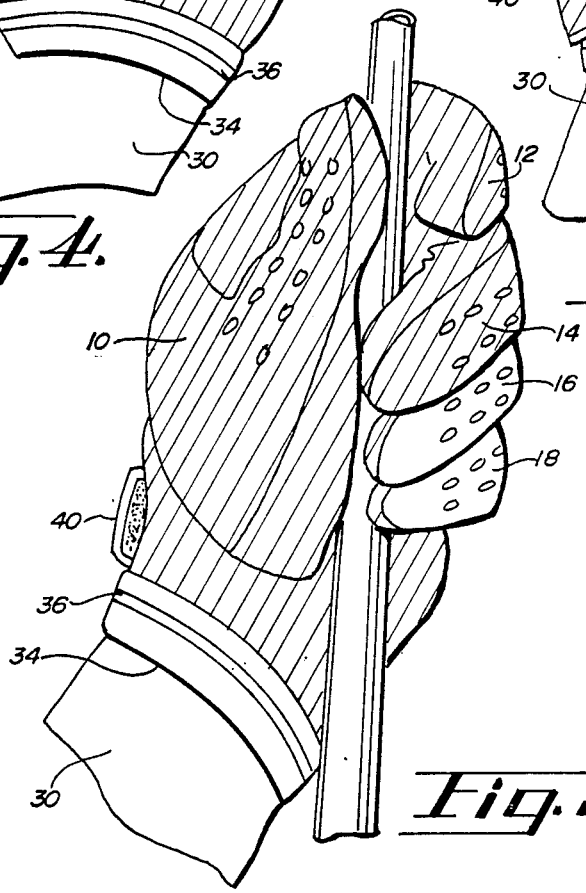
FIG. 5 is a schematic elevational view of a hand wearing the golf glove and gripping a golf club in a weak grip as the user would view it.

Finally, a weak grip such as illustrated in FIG. 5 is one wherein the only portion of the indicator panel area viewable by the golfer in the addressing stance is that along the ends of the little finger backside area 18 and possibly the ring finger backside area 16. Sometimes a weak grip may be desired, as in cases where relatively short ball travel is fondly hoped for by the golfer, so as not to overshoot the green.

All of these benefits arise from the special indicator panel area 50 as a golfer employs the glove in the standard manner of any golf glove.

Those skilled in the art will appreciate that the invention may be embodied in other specific forms than that illustrated without departing from the spirit or essential characteristics thereof. The illustrated embodiment is therefore to be considered in all respects as illustrative and not restrictive, the scope of the invention being indicated by the appended claims rather than by the foregoing description; and all changes which come within the meaning and equivalency of the claims are therefore intended to be embraced thereby.

That which is claimed is:

1. As a new article of manufacture: a golf glove for the hand of a user placed highest on the shaft of a golf club, said glove comprising backside panel areas of material forming the backside of the glove, said backside panel areas including a grip indicator panel area defined as the area covering the backside of the user's little and ring fingers down to the tip thereof and also covering the portion of the backside of the body of the user's hand between the outside edge thereof and a line substantially parallel to said outside edge intersecting the juncture between the user's ring and middle fingers, said indicator panel area being visually distinct form all other material of the backside panel areas of the glove such that a user gripping the shaft of a golf club while addressing a golf ball may employ said indicator panel area to determine orientation of grip by noting his or her ability or inability to visually observe any significant portion of said indicator panel area.

2. The golf glove of claim 1 wherein said material of the indicator panel area comprises leather.

3. The golf glove of claim 1 wherein said material of the indicator panel area comprises a tightly woven cloth material.

4. The golf glove of claim 1 wherein said material of the indicator panel area comprises an open weave mesh.

5. The golf glove of claim 1 wherein the visual distinctness of the indicator panel area is achieved by an outer surface color throughout the indicator panel area of eye-catching distinctness from the visual appearance features of the remaining backside panel areas of the glove.

6. The golf glove of claim 1 wherein the visual distinctness of the indicator panel area is achieved by an outer surface visual pattern throughout the indicator panel area of eye-catching distinctness from the visual appearance features of the remaining backside panel areas of the glove.

7. The golf glove of claim 1 wherein the visual distinctness of the indicator panel area is achieved by material forming the indicator panel area of eye-catching visual distinctness from the material of the remaining backside panel areas of the glove

8. The golf glove of claim 1 having a V-shaped slit extending from the cuff of the glove into said indicator panel area, and having cooperative fastening members on opposite sides of said slit, and wherein the line substantially parallel to said outside edge terminates at said cooperative fastening members, and wherein said indicator panel area excludes said fastening members but otherwise extends substantially to the cuff of the glove on the side of said slit adjacent said outside edge.

9. A method for a golfer to determine by visual glance whether or not the golfer has applied a correct grip on the shaft of a golf club while addressing a golf ball, comprising:

(a) constructing a golf glove for the hand of the golfer to be placed highest on the shaft of a golf club, said glove comprising backside panel areas forming the backside of the glove, said backside panel areas including a grip indicator panel area defined as the area covering the backside of the golfer's little and ring fingers down to the tip thereof and also covering the portion of the backside of the body of the golfer's hand between the outside edge thereof and a line substantially parallel to said outside edge intersecting the juncture between the golfer's ring and middle fingers, said indicator panel area being visually distinct from all other backside panel areas of the glove, (b) placing the golf glove on the hand of the golfer selected for placement highest on the shaft of a golf club, (c) addressing a golf ball as a preliminary to swinging a golf club to strike the ball, (d) gripping the handle of a selected golf club with the hand covered by the golf glove while maintaining a position addressing the ball, (e) visually observing the grip by the gloved hand on the golf club while maintaining the address and grip position, to thereby note whether or not any significant portion or said indicator panel area is visible to the golfer, and (f) adjusting the grip by turning the gloved hand on the shaft of the golf club to substantially obscure all portions of said indicator panel area from view of the golfer or to reveal a portion of the indicator panel area to the golfer at either the backside of the little and ring fingers or at the backside of the hand body, depending upon the grip orientation desired by the golfer.

* * * * *